US005597591A

United States Patent [19]

Hagenah

[11] Patent Number: 5,597,591

[45] Date of Patent: Jan. 28, 1997

[54] APPARATUS FOR THE PRODUCTION OF CONCRETE PAVING STONES

[75] Inventor: Gerhard Hagenah, Worpswede, Germany

[73] Assignee: SF-Kooperation GmbH Beton-Konzepte, Bremen, Germany

[21] Appl. No.: 378,458

[22] Filed: Jan. 26, 1995

[30] Foreign Application Priority Data

Jan. 27, 1994 [DE] Germany ..... 44 02 281.6

[51] Int. Cl.[6] ..... B28B 3/06

[52] U.S. Cl. ..... 425/346; 425/412; 52/603

[58] Field of Search ..... 425/346, 356, 425/357, 358, 412; 52/603

[56] References Cited

U.S. PATENT DOCUMENTS

| | | | |
|---|---|---|---|
| 1,030,591 | 6/1912 | Latulip | 425/356 |
| 2,499,530 | 3/1950 | Scott | 425/356 |
| 2,624,928 | 1/1953 | Long | 425/358 |
| 4,732,600 | 3/1988 | Schiller | 425/357 |
| 4,875,803 | 10/1989 | Scales . | |

FOREIGN PATENT DOCUMENTS

| | | |
|---|---|---|
| 0636755A1 | 1/1995 | European Pat. Off. . |
| 2758259 | 5/1979 | Germany . |
| 3303225A1 | 8/1984 | Germany . |
| 3703368A1 | 8/1988 | Germany . |
| 3733707A1 | 4/1989 | Germany . |
| 8900276.8 | 2/1990 | Germany . |
| 3843169A1 | 6/1990 | Germany . |
| 3937622A1 | 5/1991 | Germany . |
| 3936527A1 | 5/1991 | Germany . |
| 4221900A1 | 1/1994 | Germany . |

*Primary Examiner*—James P. Mackey
*Attorney, Agent, or Firm*—Deveau, Colton & Marquis

[57] ABSTRACT

An apparatus for the production of concrete paving stones, including an open top mold having a number of die cavities each with adjoining recesses, wherein the free volume of the recesses is reduced by local cross-sectional constrictions at the upper filling-in region of the recesses. Also included is a pressure ram for cooperation with each die cavity, the pressure ram having lateral projections each with a contour corresponding to the cross-section of the recesses at the constriction for entering into the recesses.

5 Claims, 5 Drawing Sheets

APPARATUS FOR THE PRODUCTION OF CONCRETE PAVING STONES

BACKGROUND OF THE INVENTION

1. Field of the Invention

The invention relates to a process for the production of concrete paving stones having, in the region of upright side faces, web-like distance pieces, the height of which is smaller than the height of the rest of the paving stone, the paving stones being produced in a concrete mold, which is preferably provided with a plurality of individual molds with adjacent recesses, by filling the fresh concrete into the concrete mold which is open at the top, and subsequently compacting the concrete. The invention furthermore relates to an apparatus for carrying out this process, and to a concrete paving stone which is produced by means of the foregoing process and apparatus.

Concrete paving stones having, on their side faces, integral distance pieces, which are thus also made of concrete, are gaining increasingly in importance for making so-called lawn pavings.

To this end, the distance pieces have a dimension (thickness) which creates relatively wide gaps within the ready laid paved floor. These gaps are filled with soil and allow the growth of plants, especially lawn, within the gaps.

2. Description of the Related Art

The industrial production of such concrete paving stones creates problems because of the smaller height of the distance pieces compared to the paving stone itself. The concrete molds which were mostly used in practice hitherto are comprised of a molding box with die cavities having recesses for forming the distance pieces which are arranged in separating walls of the molding box, and which extend over the entire height thereof. The fresh concrete is filled into the die cavities and the recesses from the top. For compacting and shaping the concrete paving stones, a pressure device is lowered onto the molding box from above. Individual pressure rams enter into the die cavities with die plates. Projections arranged on the sides of the die plates are assigned to the recesses and compact the concrete within the recesses. The projections have a greater overall height than the die plate itself and project downwardly therefrom. As a result, the smaller height of the distance pieces is formed during the compaction of the concrete.

Since the recesses are filled with fresh concrete over their entire height, a higher compaction is created inside the recesses than in the region of the die cavities. This may result in a lower compaction of the concrete blocks themselves. Moreover, as a result of the higher compaction in the region of the recesses, residual concrete is taken along when moving the molding die upwards, specifically also in a region of the top side of the concrete paving stone adjoining the distance pieces. As a result, a relatively large number of rejects is produced.

SUMMARY OF THE INVENTION

The invention is based on the object to propose measures by means of which the disadvantages explained above are avoided and concrete blocks, namely concrete paving stones with distance pieces of less overall height, can be produced without any disadvantages in the production.

To attain this object, the process according to the invention is characterized in that a quantity of concrete, which corresponds to the volume of the distance pieces after compaction, or which is slightly smaller, is filled into the recesses for the distance pieces which are open at the top.

In the process according to the invention, it is thus avoided that, as a result of a too large quantity of concrete, an increased pressure is created in the recesses during the compaction, which results in a decrease of pressure in the region of the concrete blocks themselves. Owing to the proposal according to the invention, the concrete in the recesses is subjected to the same force of pressure, or a slightly lower force of pressure, than the concrete blocks themselves.

In the apparatus according to the invention for producing such concrete paving stones, namely a concrete mold, the free volume of the recesses for the distance pieces is reduced by means of local cross-sectional constrictions, especially in the upper filling-in region, such that the concrete filled-in corresponds to the volume of the distance piece after compaction. This also allows an easy demold of the paving stones when, after compaction, the molding box and then the pressure rams are lifted off.

The apparatus for the production of the concrete blocks is a basically conventional molding box which is open at the top and has a plurality of die cavities, one for each concrete block, and recesses for the distance pieces in the region of separating walls. According to the invention, the recesses for the distance pieces are provided with cross-sectional constrictions in the upper region by means of projections or webs. In particular, the recesses, in their upper region, are designed in the manner of a hammer head.

On the molding dies there are provided lateral projections, specifically webs, for entering into the recesses. The cross section of the webs corresponds to that of the recesses in the upper, constricted region.

The webs on the die plates are designed with a head, the lower side of which is provided with a downwardly converging, especially hemispherical surface. As a result, a self-adjustment takes place when lowering the die plate with respect to the molding box or the recesses. The concrete blocks produced in such a concrete mold are provided with a trough-shaped depression in the region of the distance pieces at the top sides thereof.

The concrete blocks are designed in a special manner regarding the arrangement of the distance pieces. On a side face, two distance pieces are arranged at a small distance from upright edges of the concrete block. The two adjacent side faces are each provided with one distance piece. However, these distance pieces are arranged approx. diametrically of one another at small distances from upright edges. The fourth side face of the paving stone does not have any distance pieces. A paving stone designed in this manner can be laid in either cross bond or half bond. Further details of the invention are described hereinbelow with reference to the drawings, in which:

DESCRIPTION OF THE PREFERRED EMBODIMENTS

Figure 2:
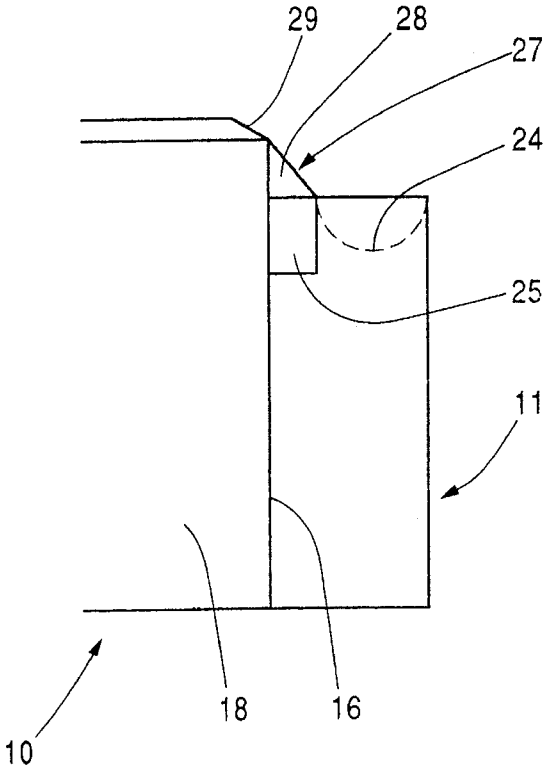
FIG. 2 shows a side view of a detail of the concrete paving stone according to FIG. 1, on an enlarged scale.
Figure 1:
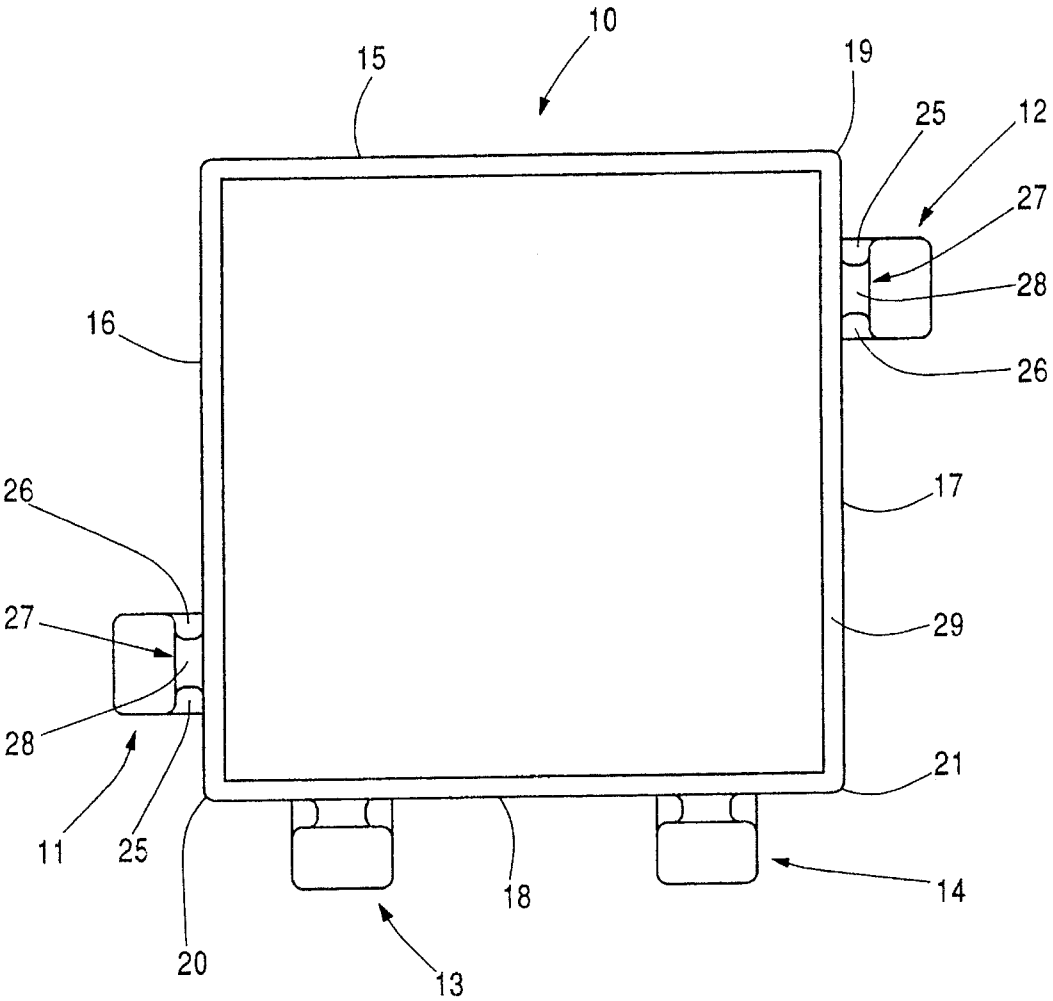
FIG. 1 shows a plan view of a concrete paving stone.

The exemplary embodiments shown in the drawings relate to a special arrangement and design of distance pieces 11, 12, 13 and 14 regarding the design of the concrete paving stones 10. These distance pieces are integral to a square body of the concrete paving stone 10, and are thus also made from concrete. The concrete paving stone 10, which has a square ground plan, is provided with four upright side faces 15, 16, 17, 18. Four distance pieces 11 to 14 are arranged on these side faces. The arrangement is chosen such that one distance piece is arranged on each of the two opposing side faces 16 and 17. These two distance pieces 11 are disposed almost diametrically opposed of one another. The side face 18 is provided with two distance pieces 13 and 14 arranged at a distance from one another.

The distance pieces 11 to 14 in the present exemplary embodiment are arranged at predetermined distances from adjacent vertical edges 19, 20, 21 of the concrete paving stones. All four distance pieces 11 to 14 are arranged at the same distance from an adjacent vertical edge 19 to 21, the distance pieces 11 and 13 both at a distance from the same vertical edge 20, the distance piece 12 at a distance from the vertical edge 19, and the distance piece 14 at a distance from the vertical edge 21.

In an actual exemplary embodiment, the length of the edge of the concrete paving stone 10 or of the concrete body is 173 mm, the thickness or strength of the distance pieces 11 to 14 is dimensioned to be 25 mm, the breadth thereof (parallel relative to the side faces 15 to 18) 27 mm. The distance of an (imagined) vertical center plane of the distance pieces to the adjacent vertical edge 19 to 21 is always 36.5 mm.

Figure 3:
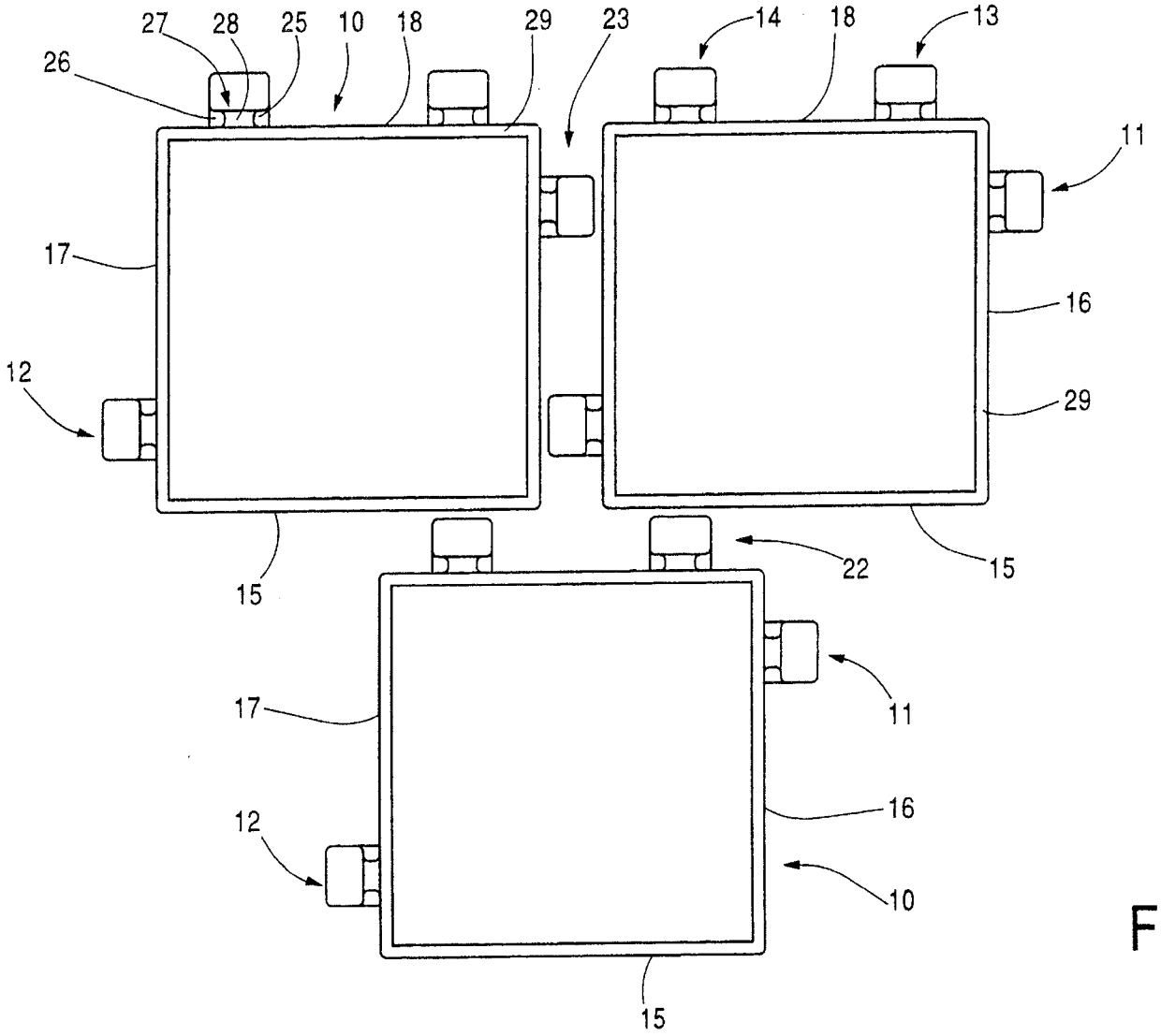
FIG. 3 shows an example for laying the concrete paving stones according to FIG. 1 in half bond.

Such a concrete paving stone 10 can be produced efficiently and laid by machine. For laying the paving stones, half bond (FIG. 3) as well as cross bond is possible. A statically stable support between adjacent concrete paving stones 10 is always ensured. The side faces 18, with two distance pieces 13 and 14 each, always extend in the region of longitudinal gaps 22. The mutually supporting distance pieces 11 and 12 are located in the transverse gaps 23. The relative position of these distance pieces 11, 12, and of the concrete paving stones 10, is chosen such that the distance pieces 11, 12 of adjacent concrete paving stones 10 cause a mutual support with the same distances as in the region of the longitudinal gaps 22.

The distance pieces 11 to 14 are designed in a special manner. As emerges especially from FIG. 2, the distance pieces 11 to 14 have a significantly smaller height than the body of the concrete paving stone 10. In the region of the top side of the distance pieces 11 to 14, a trough-shaped, especially hemispherical depression 24 is formed. Next to this depression 24 and in the region of the same, the distance piece 11 to 14 is formed having a cross-sectional constriction. These cross-sectional constrictions are two-side neckings 25, 26 which limit a centered web 27 of concrete. This web 27, in its upper region, forms a transition piece 28 which, with an inclined outer surface, extends from the top side of the distance piece 11 to 14 to the upper edge of the concrete paving stone 10. The transition piece 28 merges into a chamfer 29 of the concrete paving stone 10 which runs all-round. Below the depression 24 and the neckings 25, 26, down to the bottom side, the distance piece 11 to 14 is designed with a rectangular cross section.

Figure 4:
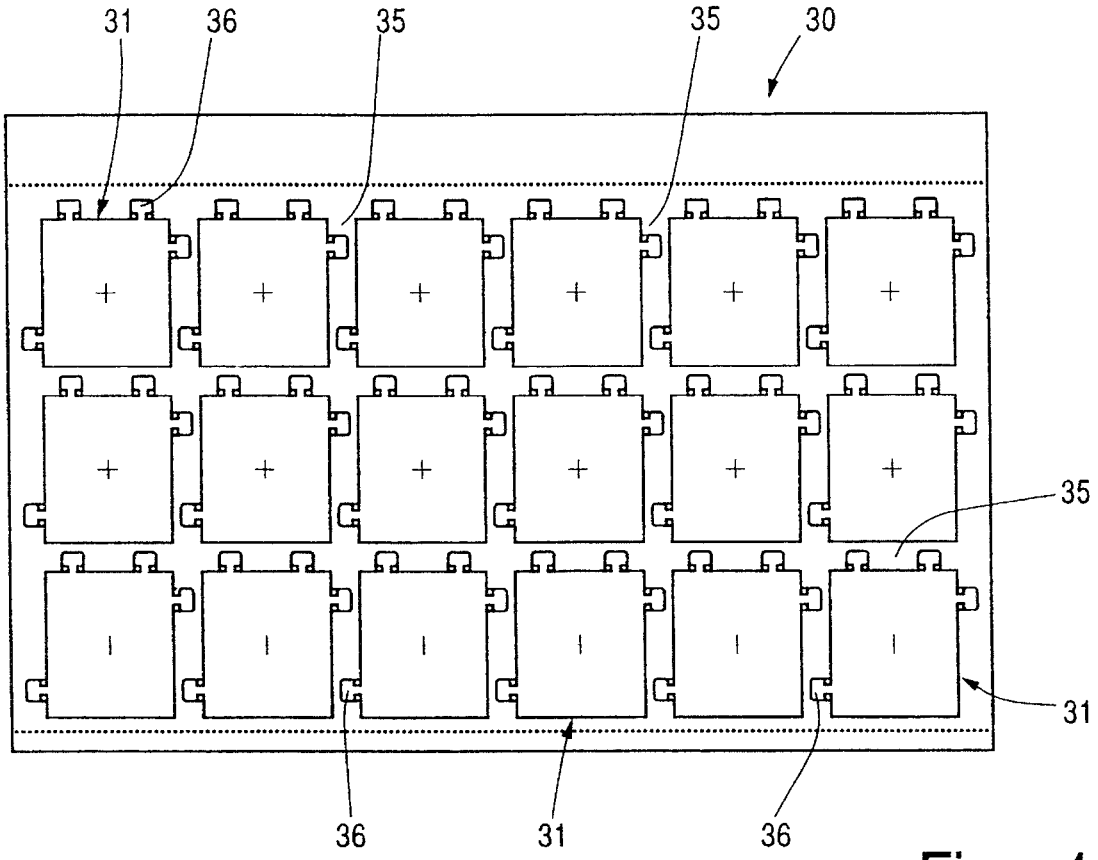
FIG. 4 shows a plan view of a molding box as a part of a concrete mold for the production of concrete paving stones according to FIG. 1.

The design of the concrete paving stone 10 and of the distance pieces 11 to 14 is related to their fabrication. The described concrete paving stones 10 are expediently produced on a conventional machine for concrete blocks. This machine is provided with at least one concrete mold. This mold, in its turn, is comprised of a molding box 30 with rectangular outer contours. The molding box 30 surrounds a plurality of die cavities 31, each for the reception of one concrete paving stone 10. In the present embodiment (FIG. 4), the molding box 30 comprises eighteen die cavities which are arranged in three rows. The formation of the die cavities 31 is chosen so that the simultaneously discharged concrete paving stones 10 form a laying unit, and thus a group of concrete paving stones 10 which can be grasped, transported and laid on the prepared ground as a unit by a laying machine.

The production of the concrete paving stones 10 normally takes place in such a manner that the molding box 30 rests on a base, a ground plate, with its die cavities 31 which are open at the bottom and the top. The fresh concrete is filled into the die cavities 31 from the top by means of a charging wagon (not shown). This charging wagon is moved to a position above the molding box 30 and thereby fills the concrete into each die cavity 31.

Thereafter, the compaction of the concrete takes place by means of vibration, on the one hand, and by means of a pressure device (not shown) which can be lowered onto the molding box 30 from the top, on the other. On this pressure device, specifically on a plate-shaped support, a number of pressure rams 32 is arranged which corresponds to the number of die cavities 31. The relative position of these pressure rams 32 corresponds exactly to the position of the die cavities 31 within the molding box 30.

Each pressure ram 32 is provided with a die plate 33 which exactly corresponds to the contour of a die cavity 31 such that the die plate 33 can be introduced into the die cavity 31 from above. Each die plate 33 is fixed to the supporting device of the pressure device by means of a supporting rod 34.

The distance pieces 11 to 14 are produced in the described concrete mold at the same time as the concrete paving stone 10. For this purpose, upright, channel-shaped recesses 36 are formed in the longitudinally and transversely directed separating walls 35 of the molding box 30. These recesses 36 extend over the entire height of the separating walls 35, and thus form a cavity former for the accommodation of fresh concrete. In the major, lower portion, the recesses 36 thus have a rectangular cross section. The concrete is also filled into the recesses from above during the filling of the die cavities 31.

On the pressure rams 32, specifically on the die plates 33, pressure members, specifically pressure webs 37 are arranged which enter into the recesses 36. These pressure webs 37 laterally project from the die plate 33 such that, in the downward movement of the die plate 33, the pressure webs 37 enter into the recesses from the top in an accurate position. The purpose of the pressure webs is to compact the concrete in the recesses 36.

The recesses 36 are designed and, regarding the free volume, dimensioned in such a manner that the quantity of concrete filled into each recess 36 corresponds to the volume of the distance piece 11 to 14 after the compaction of the concrete. Since the recesses 36 extend over the entire height of the die cavities 31 and, however, the distance pieces 11 to 14 have a smaller height, the quantity of concrete for the recesses 36 is reduced correspondingly. In the shown exemplary embodiment, this is realized by means of a cross-sectional constriction of the recesses 36 such that the available volume corresponds to the required quantity of concrete.

Figure 5:
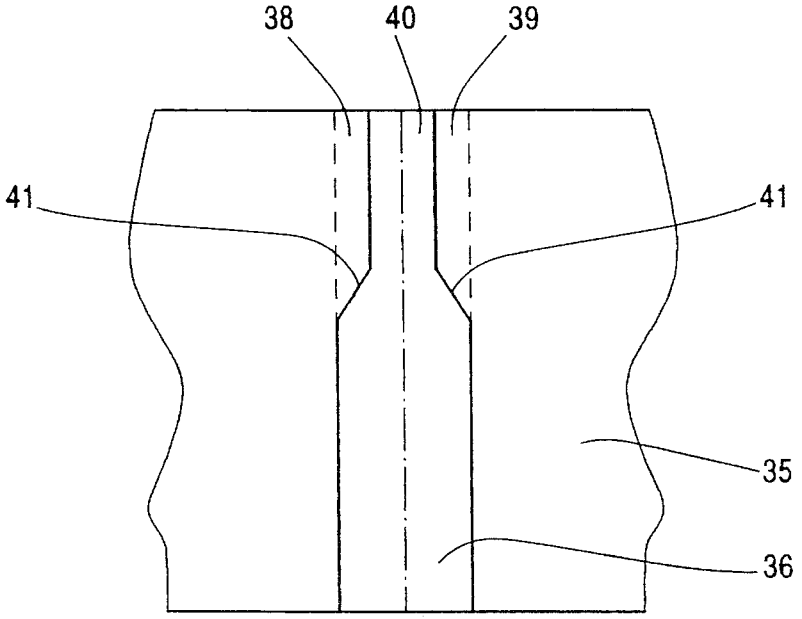
FIG. 5 shows a vertical section through a wall of the molding box according to FIG. 4, on an enlarged scale.
Figure 6:
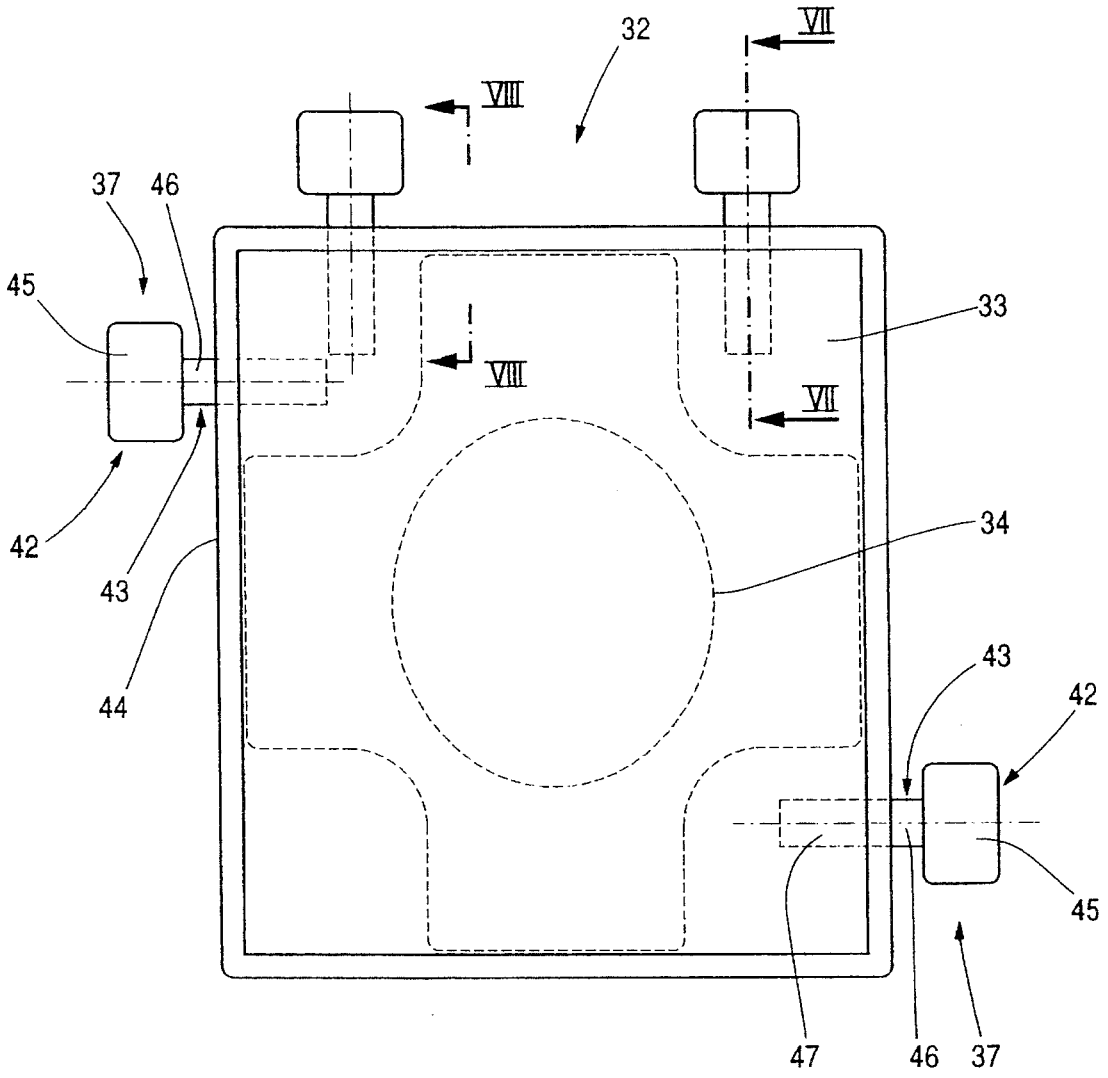
FIG. 6 shows a bottom view of an individual pressure ram as a part of the concrete mold, on an enlarged scale.
Figure 7:
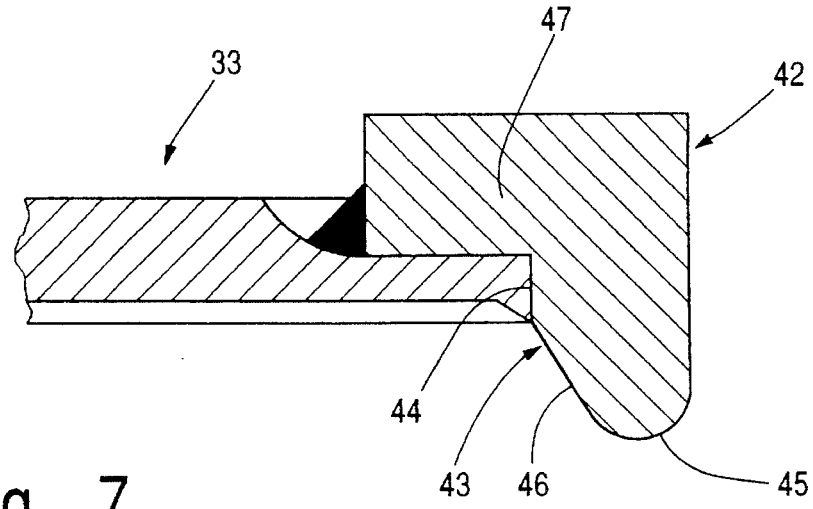
FIG. 7 shows a vertical section through a pressure ram in the region of a projection (cutting plane VII—VII in FIG. 6), on an enlarged scale.
Figure 8:
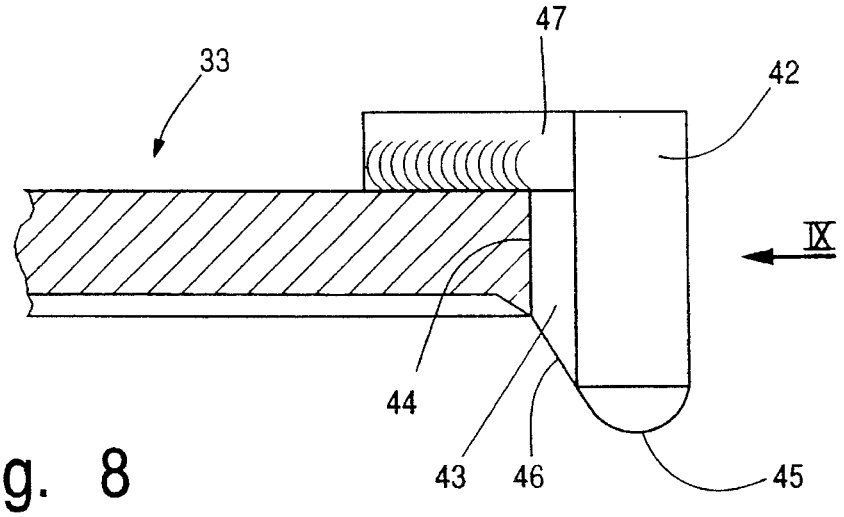
FIG. 8 shows a top view of a web of the pressure ram according to FIG. 6, also on an enlarged scale (cutting plane VIII—VIII)
Figure 9:
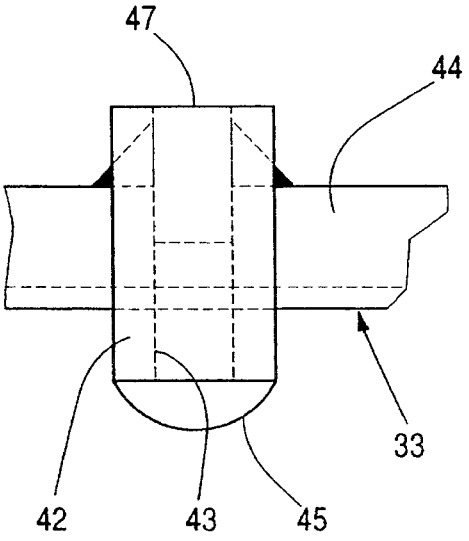
FIG. 9 shows the web according to FIG. 8 in a view IX.

As emerges especially from FIG. 5, the recesses 36 are provided with a cross-sectional constriction in the upper region, specifically by means of projections 38, 39. These projections enter into the recesses 36 from opposing sides, namely in a region immediately adjacent to he outer contours of the die cavities 31. As a result, a necking 40 is formed in the upper region of the recess 36. The projections 38, 39, at their bottoms, adjoin inner faces of the recesses 36 with inclined transitions 41.

The contour of the pressure webs 37 corresponds to the design of the cross section of the recesses 36 in the region of the necking 40. Outside of this necking 40, a head piece 42 of the pressure web is effective. This head piece 42 has the cross-sectional dimensions of the recess 36 in the region outside of the necking 40. The head piece 42 is connected to the die plate 33, specifically a lateral limitation 44 thereof, via a neck piece 43. The neck piece 43 enters into the recess 36 in the region of the necking 40.

The pressure web 37 functions as a pressure device inside the recess 36. The bottom side of the head piece 42 is designed so as to converge downwardly, in the present case with an arcuate, namely hemispherical pressure face 45. As a result of the downwardly converging design of the pressure web 37, or the head piece 42, the pressure webs have a self-centering effect with respect to the die cavities 31, or with respect to the recesses 36, when the die plates 33 with the pressure webs 37 are guided into the die cavities 31 from above.

The effective height or the depth of immersion of the pressure web 37 and the head piece 42 into the recess 36 corresponds to the height or the upper contour of the distance piece 11 to 14. The concrete is thus pressed downwards inside of the recess 36 or in the region of the necking 40 over such a distance that the smaller height of the distance piece 11 to 14 described in conjunction with FIG. 2 is obtained. The lower spherical pressure face 45 thereby shapes the depression 24.

In the region of the neck piece 43, an inclined pressure face 46 is formed on the bottom side, which takes effect in the region of the necking 40. This pressure face 46 forms a continuous transition from the lower pressure face 45 to the bottom side of the die plate 33.

To increase the dimensional stability of the pressure web 37 it is reinforced on its top side by a profile piece 47, which extends from the outer edge of the pressure web 37 into the region of the die plate 33. The profile piece 47 is welded together with the pressure web 37, on the one hand, and the top side of the die plate 33, on the other.

As a result of the described embodiment of the pressure ram 32, or the die plate 33 with the pressure webs 37, in conjunction with the design of the recesses 36, it is achieved that, in the region of the recesses for forming the distance pieces 11 to 14, the pressure exerted during the compaction is not higher than the pressure exerted by the die plate 33 in the region of the die cavities 31. As a result of corresponding dimensioning or design of the recesses 36, the quantity of concrete can be determined such that, inside of the recesses 36, slightly less pressure is exerted on the concrete than in the die cavity 31. Thereby, an accurate, faultless production of the concrete blocks is ensured.

The demold of the concrete paving stones 10 takes place as in conventional concrete molds. After compaction, the molding box is moved upwards first while the die plates 33 hold the fresh concrete paving stones 10 on the base. Afterwards, the pressure rams 32 are lifted up. Then the pressure means, namely the pressure rams 32, are cleaned on the bottom side, especially by brushes, to remove residual concrete. This cleaning process can also be conducted in a particularly effective manner in the region of the pressure webs 37, in the case of the present die plates 33. The outer faces which are free of edges or steps reduce the residual concrete, and simplify the cleaning process by brushes which take effect on the die plates 33 and the pressure webs 37 from the bottom.

I claim:

1. An apparatus for the production of paving stones, said apparatus comprising:

(a) an open top mold having a plurality of die cavities each with adjoining recesses, said recesses further comprising a free volume and an upper filling-in region, wherein said free volume of said recesses is reduced by local cross-sectional constrictions at said upper filling-in region of said recesses; and (b) a pressure ram for cooperation with each said die cavity, said pressure ram having lateral projections each having a contour corresponding to said recesses at said constrictions.

2. An apparatus according to claim 1, wherein said lateral projections comprise pressure webs having a head connected to said pressure ram by a connecting web.

3. An apparatus according to claim 2, wherein said lateral projections further comprise an outwardly inclined, approximately oblique contour, whereby said lateral projections have a greatest overall height proximal said head.

4. An apparatus according to claim 1, wherein said recesses comprise upright, channel-shaped recesses.

5. An apparatus according to claim 2, wherein said local cross-sectional constrictions comprise projections protruding into said recesses, whereby a constricted, channel-like connection between said die cavities and said recesses is formed adjacent said upper filling-in region.

* * * * *